US007086568B1

(12) United States Patent
Cheek

(10) Patent No.: US 7,086,568 B1
(45) Date of Patent: Aug. 8, 2006

(54) TOOTHPASTE DISPENSER

(76) Inventor: Everett Cheek, 31 F. Flintlock, Ledyard, CT (US) 66339

( * ) Notice: Subject to any disclaimer, the term of this patent is extended or adjusted under 35 U.S.C. 154(b) by 0 days.

(21) Appl. No.: 10/919,089

(22) Filed: Aug. 15, 2004

Related U.S. Application Data

(60) Provisional application No. 60/495,246, filed on Aug. 15, 2003.

(51) Int. Cl.
*B65D 35/28* (2006.01)

(52) U.S. Cl. ..... 222/103; 222/95; 222/105; 222/181.3

(58) Field of Classification Search ..... 222/105, 222/94, 98–103, 106–107, 95, 185.1, 181.3, 222/181.2, 181.1, 386, 213–214
See application file for complete search history.

(56) References Cited

U.S. PATENT DOCUMENTS

| | | | | |
|---|---|---|---|---|
| 2,568,286 | A * | 9/1951 | Littlefield | 222/103 |
| 2,587,191 | A * | 2/1952 | Merullo | 222/103 |
| 3,194,440 | A * | 7/1965 | Watson, Jr. | 222/93 |
| 3,368,722 | A * | 2/1968 | Wallace | 222/214 |
| 3,380,631 | A * | 4/1968 | Perrinjaquet | 222/96 |
| 3,908,863 | A * | 9/1975 | White | 222/103 |
| 4,742,940 | A | 5/1988 | Wilkinson | |
| 5,067,635 | A * | 11/1991 | Thomsen | 222/103 |
| 5,105,984 | A * | 4/1992 | Kazimir | 222/103 |
| 5,195,659 | A | 3/1993 | Eiskant | |
| 5,277,332 | A * | 1/1994 | Rogers | 221/96 |
| 5,810,205 | A | 9/1998 | Kohen | |
| 5,857,592 | A * | 1/1999 | Hyldgaard et al. | 222/96 |
| 6,454,133 | B1 * | 9/2002 | Lopez et al. | 222/102 |
| 6,719,169 | B1 * | 4/2004 | Gandy | 222/1 |
| 2004/0035880 | A1 * | 2/2004 | Coleman et al. | 222/95 |

* cited by examiner

*Primary Examiner*—Frederick C. Nicolas

(57) ABSTRACT

A household apparatus for dispensing toothpaste from a tube of toothpaste. The apparatus is a toothpaste dispenser which is removably mounted to a wall surface. The tube of toothpaste is mounted within the dispenser and can have a small volume of toothpaste dispensed by pushing inward on a plunger that is connected to the toothpaste dispenser.

6 Claims, 3 Drawing Sheets

TOOTHPASTE DISPENSER

CROSS-REFERENCE TO RELATED APPLICATIONS

This application claims the benefit of U.S. Provisional Application No. 60/495,246, filed Aug. 15, 2003.

BACKGROUND OF THE INVENTION

The present invention concerns that of a new and improved household apparatus for dispensing toothpaste from a tube of toothpaste.

DESCRIPTION OF THE PRIOR ART

U.S. Pat. No. 5,810,205, issued to Kohen, discloses a collapsible tube holder and dispenser for discharging such material as toothpaste.

U.S. Pat. No. 5,195,659, issued to Eiskant, discloses a dispenser assembly comprised of two halves for holding a tube of toothpaste and a plunger for providing a discreet amount to a user.

U.S. Pat. No. 4,742,940, issued to Wilkinson, discloses a dispenser for a flowable material such as toothpaste from a hollow cylinder with a plunger assembly.

SUMMARY OF THE INVENTION

The present invention concerns that of a new and improved household apparatus for dispensing toothpaste from a tube of toothpaste. The apparatus is a toothpaste dispenser which is removably mounted to a wall surface. The tube of toothpaste is mounted within the dispenser and can have a small volume of toothpaste dispensed by pushing inward on a plunger that is connected to the toothpaste dispenser.

There has thus been outlined, rather broadly, the more important features of a toothpaste dispenser that the detailed description thereof that follows may be better understood and in order that the present contribution to the art may be better appreciated. There are, of course, additional features of the toothpaste dispenser that will be described hereinafter and which will form the subject matter of the claims appended hereto.

In this respect, before explaining at least one embodiment of the toothpaste dispenser in detail, it is to be understood that the toothpaste dispenser is not limited in its application to the details of construction and to the arrangements of the components set forth in the following description or illustrated in the drawings. The toothpaste dispenser is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present toothpaste dispenser. It is important, therefore, that the claims be regarded as including such equivalent constructions insofar as they do not depart from the spirit and scope of the present invention.

It is therefore an object of the present invention to provide a toothpaste dispenser which has all of the advantages of the prior art and none of the disadvantages.

It is another object of the present invention to provide a toothpaste dispenser which may be easily and efficiently manufactured and marketed.

It is another object of the present invention to provide a toothpaste dispenser which is of durable and reliable construction.

It is yet another object of the present invention to provide a toothpaste dispenser which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
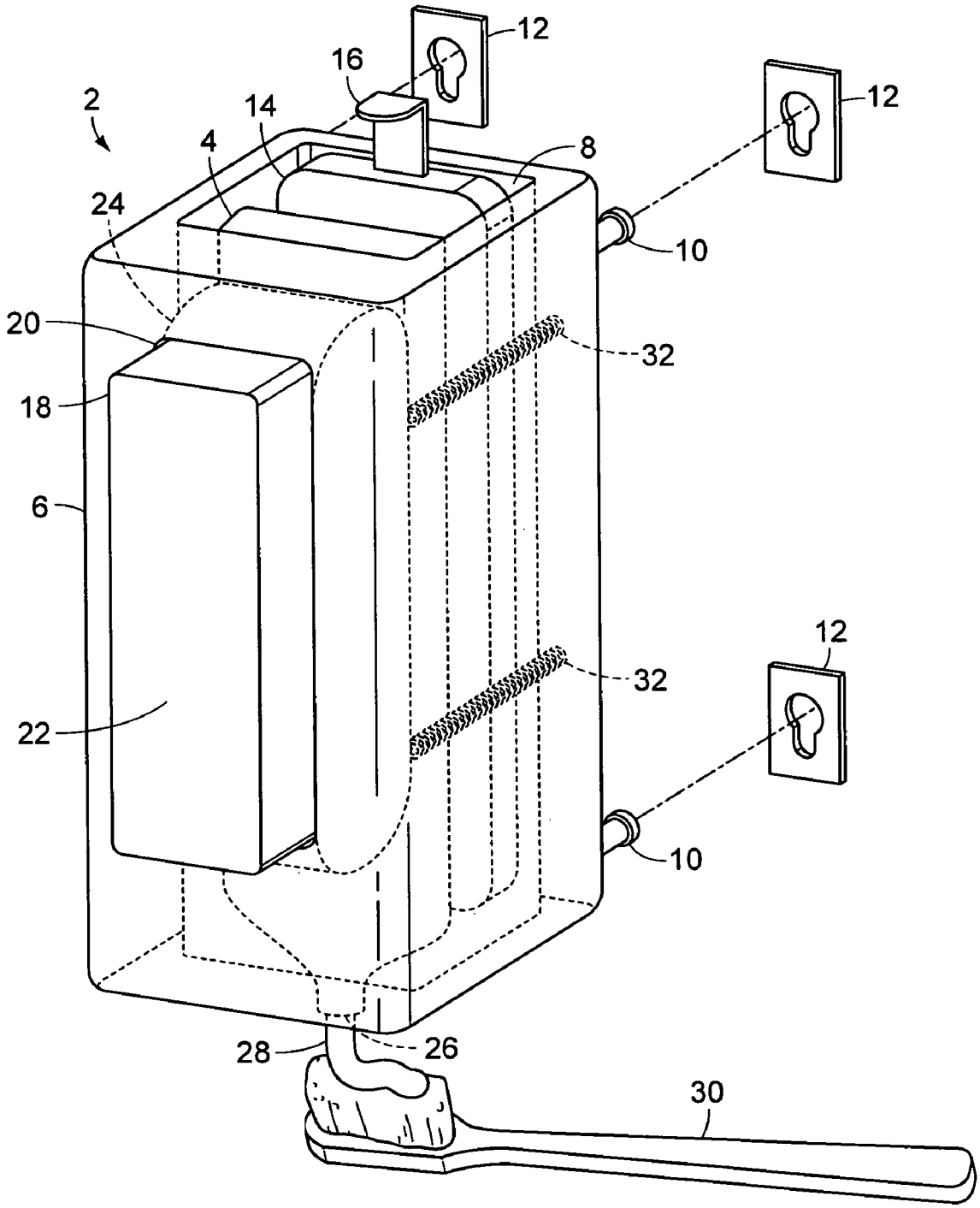
FIG. 1 shows a perspective view of the apparatus.
Figure 2:
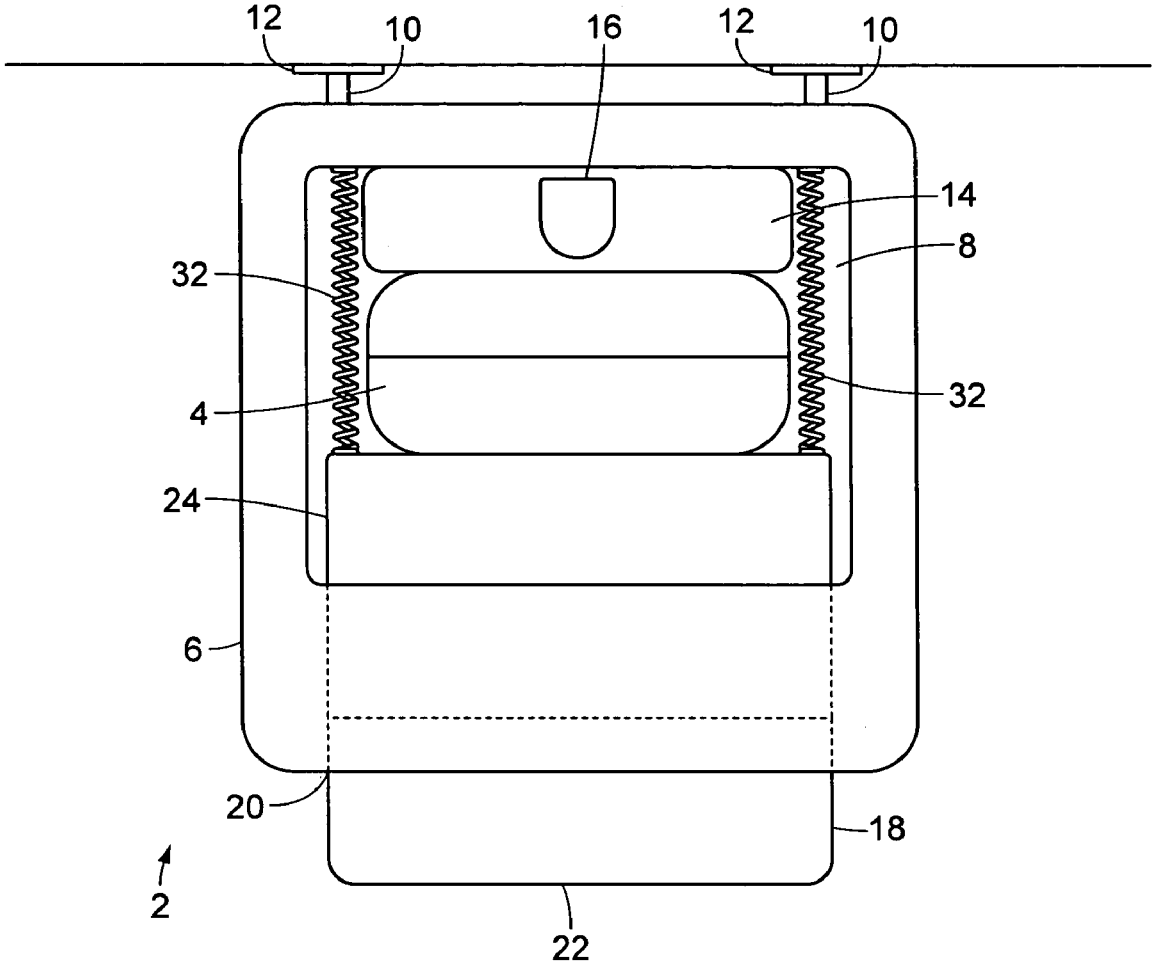
FIG. 2 shows a top view of the apparatus.
Figure 3:
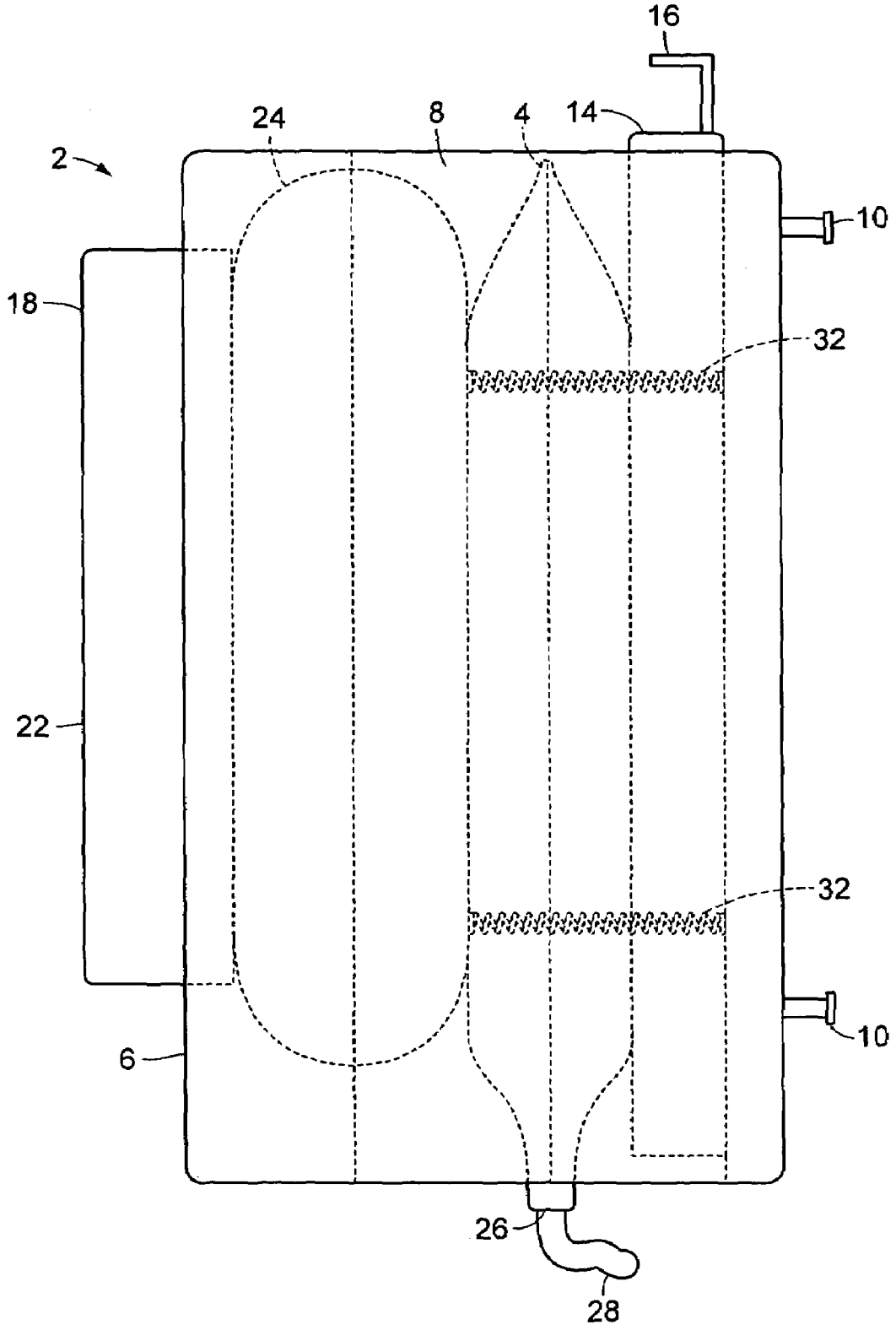
FIG. 3 shows a side view of the apparatus.

FIG. 1 shows a perspective view of the apparatus 2, FIG. 2 shows a top view of the apparatus 2, and FIG. 3 shows a side view of the apparatus 2. Apparatus 2 is a toothpaste dispenser which would be mounted within a bathroom for the purpose of dispensing a volume of toothpaste 28 from a tube of toothpaste 4.

Base unit 6 has two ends, a top end and a bottom end, and has a square cross-sectional shape. Base unit 6 has a hole 8 running through the length of base unit 6, with the cross-sectional shape of the hole 8 also being square. Base unit 6 has four external surfaces comprising a rear surface, a front surface, a left surface, and a right surface.

The rear surface of base unit 6 has a quartet of screws 10 that are fixedly attached to the rear surface of base unit 6. Each of the screws 10 can be used to mount onto a mount 12 that is attached to a wall surface.

Within hole 8 are located four inner surfaces comprising a rear inner surface, a front inner surface, a left inner surface, and a right inner surface. Within hole 8 is located spacer 14. Spacer 14 runs the length of hole 8 within base unit 6 and has two surfaces, a front surface and a rear surface, with the rear surface of spacer 14 placed against the rear inner surface within hole 8. Spacer 14 is not normally attached to the rear inner surface within hole 8, but when used in conjunction with a tube of toothpaste 4, is kind of "wedged" against the rear inner surface of hole 8.

Spacer 14 has two ends, a top end and a bottom end. The top end of spacer 14 has a small handle 16 to assist an individual in removing spacer 14 from the base unit 6. The thickness of the spacer 14 varies from the top end to the bottom end, with the top end of the spacer 14 being wider than at the bottom end.

Plunger 18 is attached to the front surface of base unit 6 and is placed within hole 20, which is a rectangular hole located on the front surface of base unit 6. Plunger 18 has two components including a handle 22 and a contact portion 24. Handle 22 is available for access by an individual, while contact portion 24 is attached to handle 22 and is located within base unit 6.

A tube of toothpaste 4, when used with the present invention, is placed within base unit 6 with the toothpaste tube cap removed and the opening 26 on the tube of toothpaste 4 facing down. Contact portion 24 is pressed up against the tube of toothpaste 4 when handle 22 is pushed inward, causing a small volume of toothpaste 28 within the tube of toothpaste 4 to be expelled onto a toothbrush 30.

Within base unit, a quartet of springs 32 are located. Each spring has two ends, a first end and a second end, with each spring 32 normally being at rest in the retracted position. The first end of each spring 32 is attached to a corner of the contact portion 24, with the second end of each spring 32 attached to the rear inner surface of the base unit 8. Each of the springs 32 has enough tensile strength to allow the plunger 18 to remain in an inward position once pushed inward slightly to expel some toothpaste, but at the same time, are not strong enough to automatically pull plunger inward and expel too much toothpaste. The plurality of springs 32, in essence, keep the plunger 18 at the position it was in at the time it was last touched by an individual. By doing this, the springs 32 keep the plunger 18 at a good "starting point" each time an individual wants to use plunger 18 again to expel additional toothpaste for future brushings.

I claim:

1. A toothpaste dispenser in combination with a tube of toothpaste, the tube of toothpaste having an opening, the tube of toothpaste including a volume of toothpaste, the toothpaste dispenser comprising:

(a) a base unit having two ends, a top end and a bottom end, the base unit having a square cross-sectional shape, the base unit having a central hole running lengthwise in the base unit from the top end to the bottom end of the base unit, the central hole having a square cross-sectional shape, the base unit having four external surfaces comprising a rear surface, a front surface, a left surface, and a right surface, the base unit also having four inner surfaces comprising a rear inner surface, a front inner surface, a left inner surface, and a right inner surface, (b) means for attaching the base unit to a wall surface, (c) a spacer having two surfaces, a front surface and a rear surface, the spacer also having two ends, a top end and a bottom end, the rear surface of the spacer being placed against the rear inner surface on the base unit, (d) a handle attached to the top end of the spacer, (e) a front hole located on the front surface of the base unit, the front hole having a rectangular shape, (f) a plunger located within the front hole, the plunger comprising a contact portion, the plunger further comprising a handle attached to the contact portion, (g) wherein the tube of toothpaste is placed within the central hole with said opening facing downward, and further wherein the plunger is pushed inward until a small volume of toothpaste within the tube of toothpaste is expelled through the opening.

2. A toothpaste dispenser in combination with a tube of toothpaste according to claim 1 wherein the means for attaching the base unit to said wall surface further comprises:

(a) a plurality of screws attached to the rear surface of the base unit, (b) a plurality of mounts attached to said wall surface, (c) wherein each screw of the plurality of screws is placed within a mount of the plurality of mounts.

3. A toothpaste dispenser in combination with a tube of toothpaste according to claim 2 wherein the plurality of screws equals four.

4. A toothpaste dispenser in combination with a tube of toothpaste according to claim 2 wherein the toothpaste dispenser further comprises means for maintaining the plunger in a set position after the plunger has been pushed in or pulled out by an individual.

5. A toothpaste dispenser in combination with a tube of toothpaste according to claim 4 wherein the means for maintaining the plunger in a set position after the plunger has been pushed in or pulled out by an individual further comprises (a) a plurality of springs, each spring having two ends, a first end and a second end, the first end of each spring attached to the contact portion of the plunger, the second end of each spring attached to the rear inner surface of the base unit, (b) wherein each of the springs has a tensile strength that balances competing inward and outward pressures to maintain the plunger in a set position after the plunger is used by an individual.

6. A toothpaste dispenser in combination with a tube of toothpaste according to claim 5 wherein the plurality of springs preferably numbers four.

* * * * *